US007432644B2

(12) United States Patent
Chang et al.

(10) Patent No.: US 7,432,644 B2
(45) Date of Patent: Oct. 7, 2008

(54) ELECTRON EMISSION DEVICE HAVING EXPANDED OUTER PERIPHERY GATE HOLES

(75) Inventors: Dong-Su Chang, Suwon-si (KR); Jae-Hoon Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 588 days.

(21) Appl. No.: 11/044,102

(22) Filed: Jan. 26, 2005

(65) Prior Publication Data

US 2005/0168132 A1 Aug. 4, 2005

(30) Foreign Application Priority Data

Jan. 29, 2004 (KR) ..... 10-2004-0005728

(51) Int. Cl.
*H01J 1/62* (2006.01)
*H01J 63/04* (2006.01)

(52) U.S. Cl. ..... 313/497; 313/293

(58) Field of Classification Search ..... None
See application file for complete search history.

(56) References Cited

U.S. PATENT DOCUMENTS 5,682,078 A * 10/1997 Shishido ..... 313/336
6,445,113 B1 * 9/2002 Seko et al. ..... 313/309
2006/0033414 A1 * 2/2006 Ahn ..... 313/293

FOREIGN PATENT DOCUMENTS

KR 1020010104550 * 11/2001

* cited by examiner

*Primary Examiner*—Karabi Guharay
*Assistant Examiner*—Britt Hanley
(74) *Attorney, Agent, or Firm*—Christie, Parker & Hale, LLP

(57) ABSTRACT

An electron emission device includes a pair of anode and cathode substrates facing each other, and cathode electrodes, an insulating layer, and gate electrodes sequentially deposited on the cathode substrate. Gate holes are formed within the respective pixels by partially removing the gate electrodes and the insulating layer. Each pixel is divided into a central pixel region and a peripheral pixel region. Electron emission regions are placed on the cathode electrodes inside the gate holes to emit electrons. Anode electrodes and a phosphor screen are formed on the anode substrate. A uniform electric field is applied to the electron emission regions arranged at the central pixel region, and a non-uniform electric field is applied to the electron emission regions arranged at the peripheral pixel region excluding the central pixel region.

19 Claims, 3 Drawing Sheets

ELECTRON EMISSION DEVICE HAVING EXPANDED OUTER PERIPHERY GATE HOLES

CROSS REFERENCE TO RELATED APPLICATION

This application claims priority to and the benefit of Korean Patent Application No. 10-2004-0005728 filed on Jan. 29, 2004 in the Korean Intellectual Property Office, the entire content of which is incorporated herein by reference.

BACKGROUND OF THE INVENTION

1. Field of the Invention

The present invention relates to an electron emission device, and in particular, to an electron emission device which differentiates the distance of electron emission regions located at the central pixel region to the gate electrode from that of the electron emission regions located at the peripheral pixel region to the gate electrode.

2. Description of Related Art

Generally, electron emission devices are classified into a first type where a hot cathode is used as an electron emission source, and a second type where a cold cathode is used as the electron emission source.

Among the second type electron emission devices, known are the field emitter array (FEA) type, the metal-insulator-metal (MIM) type, the metal-insulator-semiconductor (MIS) type, the surface conduction emitter (SCE) type, and the ballistic electron surface emitter (BSE) type.

The electron emission devices are differentiated in their specific structure depending upon the types thereof, but basically have first and second substrates forming a vacuum vessel, an electron emission unit formed at the first substrate to emit electrons, and phosphor layers formed at the second substrate to emit light, to provide the desired display.

With the FEA type of electron emission device, electron emission regions are formed with a material capable of emitting electrons under the application of an electric field, and driving electrodes, such as cathode and gate electrodes, are placed around the electron emission regions. When an electric field is formed around the electron emission regions due to the voltage difference between the cathode and the gate electrodes, electrons are emitted from the electron emission regions.

With a typical structure of the FEA typed electron emission device, cathode electrodes, an insulating layer and gate electrodes are sequentially formed on the first substrate, and openings are formed at the insulating layer and the gate electrodes while partially exposing the cathode electrodes. Electron emission regions are formed on the cathode electrodes within the openings. With another typical structure of the FEA typed electron emission device, gate electrodes, an insulating layer and cathode electrodes are sequentially formed on the first substrate, and electron emission regions are formed at the lateral sides of the cathode electrodes.

With the above-structured FEA typed electron emission device, in order to increase the amount of emitted electrons under the application of a uniform electric field, as shown in FIG. 1, the distance of the respective electron emission regions 102 to the gate electrode 104 is kept the same, the reference numeral 106 of FIG. 1 indicating a gate hole. However, such a gate electrode structure involves leakage of light at the pixel neighbors due to beam spreading, and hence, deteriorated color representation occurs.

In order to solve such a problem, as shown in FIGS. 2A and 2B, it has been proposed that the distance of the electron emission regions 102 to the gate electrode 104' in the left and right directions X-X' should be differentiated from that of the electron emission regions 102 to the gate electrode 104' in the upper and lower directions Y-Y'. Consequently, the electric field applied to the electron emission regions 102 becomes non-uniform, thereby preventing the electron beams from being spread. However, as compared to the structure shown in FIG. 1, such a structure involves a reduced amount of emitted electrons due to the application of a non-uniform electric field.

SUMMARY OF THE INVENTION

In an exemplary embodiment of the present invention, there is provided an electron emission device which simultaneously exerts an electron emission enhancement effect and a beam convergence effect.

In an exemplary embodiment of the present invention, the electron emission device includes a plurality of electron emission regions arranged within the respective pixels. Each pixel is divided into a central pixel region and a peripheral pixel region. The distance of the respective electron emission regions to the gate electrode is differentiated depending upon the locations of the electron emission regions within the pixel.

The distance of the respective electron emission regions located at the central pixel region to the gate electrode is substantially the same, and the electron emission regions located at the peripheral pixel region excluding the central pixel region are offset toward the center of the pixel.

According to another aspect of the present invention, the electron emission device includes a pair of anode and cathode substrates facing each other. Cathode electrodes, an insulating layer, and gate electrodes are sequentially deposited on the cathode substrate. Gate holes are formed within the pixel regions by partially removing the gate electrodes and the insulating layer. Electron emission regions are placed on the cathode electrodes inside the gate holes to emit electrons. Anode electrodes and a phosphor screen are formed on the anode substrate. A uniform electric field is applied to the electron emission regions arranged at the central pixel region, and a non-uniform electric field is applied to the electron emission regions are peripheral pixel region excluding the central pixel region.

The electron emission regions arranged at the peripheral pixel region are offset toward the center of the pixel such that the non-uniform electric field is applied thereto.

The offset of each electron emission region is established such that the distance thereof to the gate electrode directed toward the periphery of the pixel is 1.5 times more than the distance thereof to the gate electrode directed toward the center of the pixel.

When viewed in the longitudinal direction of the cathode electrode, the peripheral pixel region is formed at the upper and lower sides of the pixel around the central pixel region, as well as at the left and right sides of the pixel around the central pixel region. The central pixel region and the peripheral pixel region are concentrically symmetrical to each other in the upper and lower directions, as well as in the left and right directions.

The electron emission regions may be formed with a carbonaceous material or a nano-sized material or a cone-shaped metallic material, such as molybdenum.

With the above-structured the electron emission device, a uniform electric field is applied to the electron emission regions located at the central pixel region to increase the amount of emitted electrons. By contrast, a non-uniform electric field is applied to the electron emission regions at the peripheral pixel region such that electrons are emitted only from the electron emission region surface positioned close to the gate electrode, thereby preventing the electron beams from being spread.

DETAILED DESCRIPTION OF THE EMBODIMENTS

Figure 1:
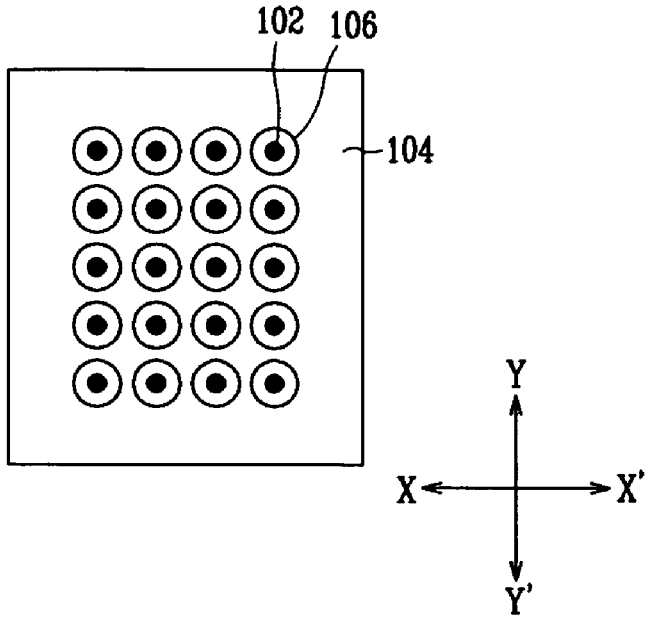
FIG. 1 (Prior Art)
FIG. 1 is a plan view of a prior art cathode substrate.
Figure 2A:
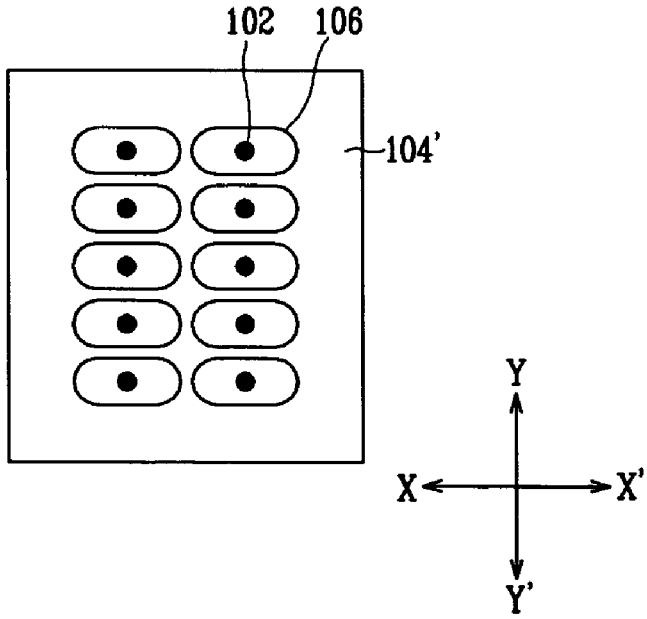
FIG. 2A (Prior Art)
FIGS. 2A and 2B are plan views of other prior art cathode substrates.
Figure 2B:
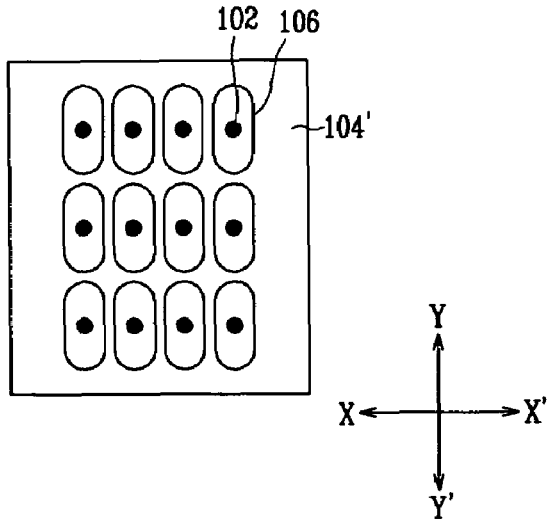
FIG.2B(Prior Art)
Figure 3:
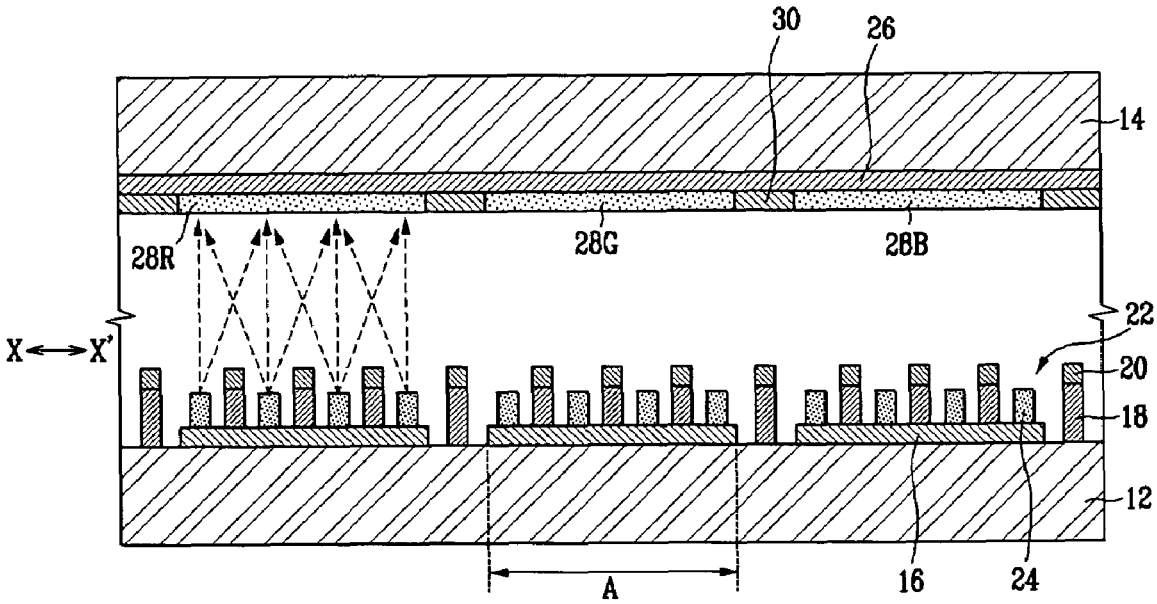
FIG. 3 is a schematic sectional view of an electron emission device according to an embodiment of the present invention.
Figure 4:
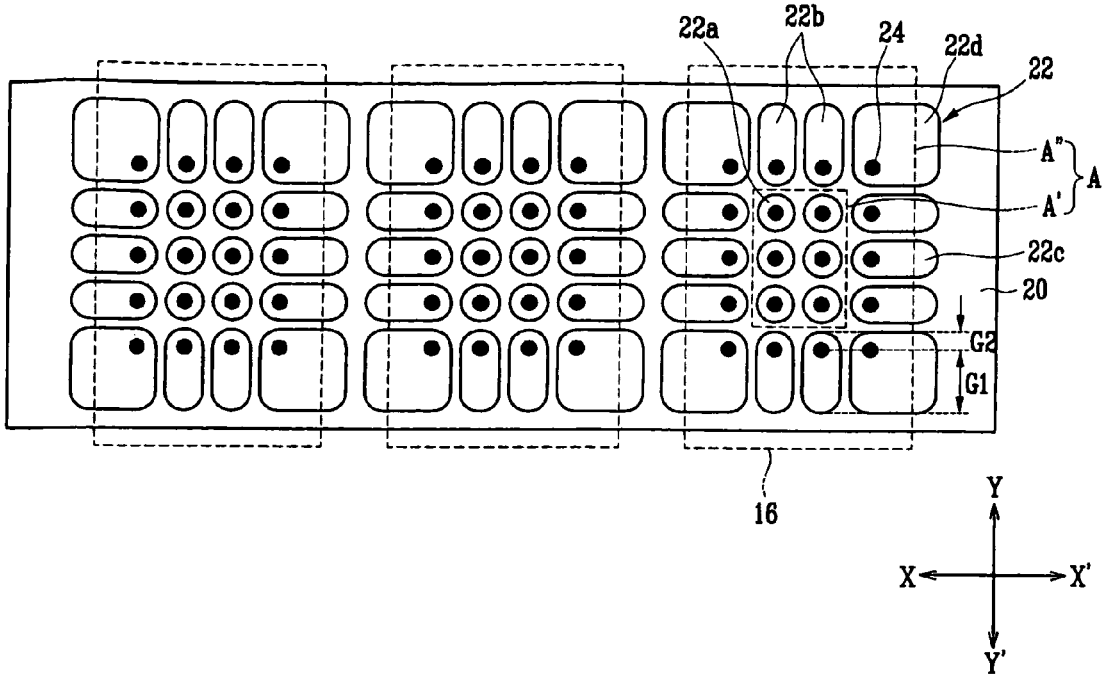
FIG. 4 is a plan view of a cathode substrate for the electron emission device according to the exemplary embodiment of the present invention shown in FIG. 3.

Referring now to FIGS. 3 and 4, the electron emission device includes a cathode substrate 12 and an anode substrate 14 facing each other with a predetermined distance therebetween to form a vacuum vessel. A structure for emitting electrons under the application of an electric field is provided at the cathode substrate 12, and a structure for displaying the target image by radiating visible rays with the electrons is provided at the anode substrate 14.

Specifically, stripe-patterned cathode electrodes 16 are arranged on the cathode substrate 12 while being spaced apart from each other by a predetermined distance. An insulating layer 18 is formed on the cathode electrodes 16. Stripe-patterned gate electrodes 20 are formed on the insulating layer 18 while being spaced apart from each other by a predetermined distance. The cathode electrodes 16 and the gate electrodes 20 cross each other.

A plurality of gate holes 22 are formed at the pixel A where the cathode electrode 16 and the gate electrode 20 cross each other such that they partially expose the cathode electrode 16. Electron emission regions 24 are formed at the exposed portions of the cathode electrode 16 with an electron emission material.

In this embodiment, the pixel A is divided into a central pixel region and a peripheral pixel region, and the distance of the electron emission regions located at the central pixel region to the gate electrode is differentiated from that of the electron emission regions located at the peripheral pixel region to the gate electrode. This will be specifically explained with reference to FIG. 4, which illustrates the main components of the cathode substrate according to an embodiment of the present invention.

As shown in FIG. 4, twenty gate holes 22 are formed at each pixel A, and electron emission regions 24 for emitting electrons are formed on the surface portions of the cathode electrode 16 exposed through the gate holes 22.

In this embodiment, the electron emission regions 24 are flat typed emitters with a substantially even thickness, and are formed using a carbonaceous material that emits electrons well under the low voltage driving condition of about 10-100V. The carbonaceous material for the electron emission regions 24 may be selected from graphite, diamond, diamond-like carbon, carbon nanotubes, and $C_{60}$ (fullerene), or a combination thereof. Among the candidate materials, the carbon nanotubes are known as ideal electron emission source as they have a very fine terminal curvature radius of several to several tens of nanometers, and they emit electrons well even under the application of low electric field of 1-10V/μm.

The electron emission regions may be formed using a nanometer-sized material, such as nano-tubes, graphite nanofiber, and silicon nano-wire.

Furthermore, the electron emission regions may be formed with a metallic material such as molybdenum, in the shape of a cone.

The pixel A is divided into a central pixel region A' and a peripheral pixel region A". Six circular gate holes 22*a* are formed at the central pixel region A' such that a uniform electric field can be applied to the electron emission regions 24 placed within that region. Fourteen gate holes 22*b*, 22*c*, and 22*d* are formed at the peripheral pixel region A" surrounding the central pixel region A' in all directions such that a non-uniform electric field can be applied to the electron emission regions 24 placed within that region.

Among the gate holes formed at the peripheral pixel region A" to apply the non-uniform electric field, the gate holes 22*b* formed at the upper and lower sides of the pixel around the central pixel region A' are longitudinally extended in the upper and lower directions Y-Y' with a generally rectangular shape having rounded corners, and the gate holes 22*c* formed at the left and right sides of the pixel around the central pixel region A' are longitudinally extended in the left and right X-X' directions with a generally rectangular shape having rounded corners. The gate holes 22*d* formed at the corners of the pixel around the central pixel region A' are formed with a generally square shape having rounded corners.

The electron emission regions 24 placed within the gate holes 22*b*, 22*c*, and 22*d* formed at the peripheral pixel region A" are offset toward the center of the pixel such that the distance G1 thereof to the gate electrode 20 directed toward the periphery of the pixel is approximately 1.5 times greater than the distance G2 thereof to the gate electrode 20 directed toward the center of the pixel.

The structural components at the peripheral pixel region A" may be substantially symmetrical to each other in the upper and lower directions, as well as in the left and right directions.

With the above structure, the amount of emitted electrons at the central pixel region A' is increased because a uniform electric field is applied to the electron emission regions 24 located at that region. By contrast, the beam spreading at the peripheral pixel region A" is prevented because the electrons are emitted only from the electron emission region surface positioned close to the gate electrode.

Referring back to FIG. 3, a plurality of stripe-patterned anode electrodes 26 are formed on the surface of the anode substrate 14 facing the cathode substrate 12 while being spaced apart from each other by a predetermined distance. Red, green, and blue phosphors 28R, 28G, and 28B are formed on the anode electrodes 26. A black layer 30 is formed between the phosphor neighbors.

Figure 5:
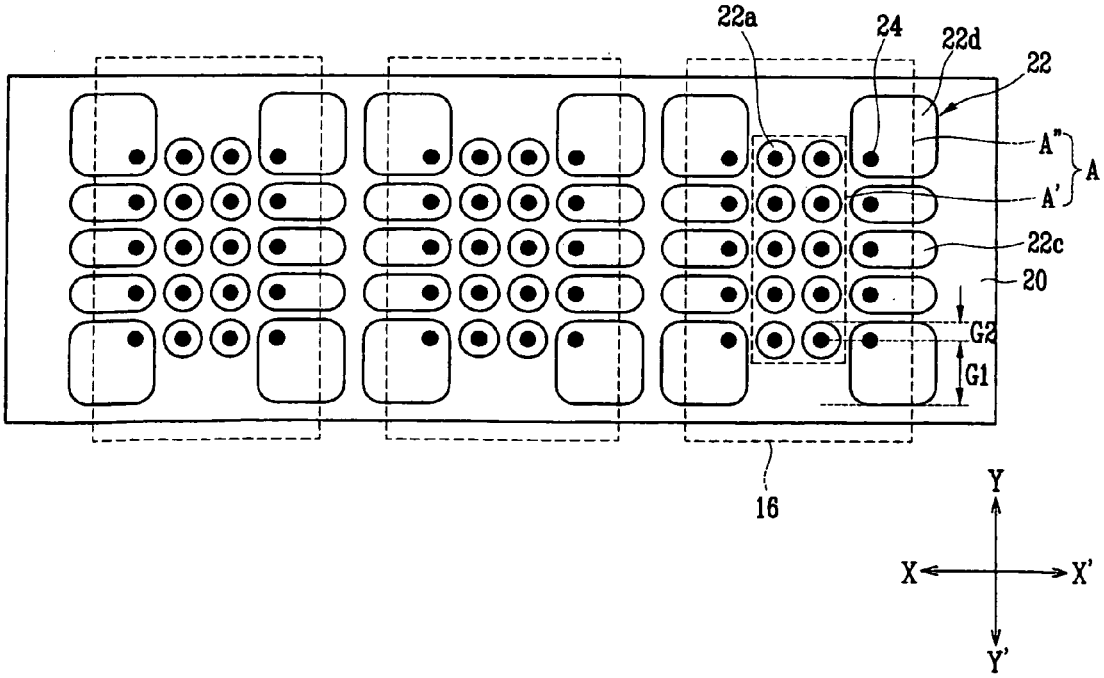
FIG. 5 is a plan view of a cathode substrate according to a further exemplary embodiment of the present invention.

FIG. 5 illustrates the main components of a cathode substrate according to a further exemplary embodiment of the present invention. In this embodiment, the central pixel region A' is extended in the upper and lower directions Y-Y', and the peripheral pixel region A" is formed only at the sides of the pixel around the central pixel region A' in the left and right directions X-X'. In FIG. 5, the same structural components of the cathode substrate as those related to the embodiment illustrated in FIG. 4 are indicated by like reference numerals, and hence, detailed explanation thereof will be omitted.

The distance between the respective electron emission regions and the gate electrode may be differentiated depending upon the locations of the electron emission regions within the pixel, in various manners.

As described above, with the central pixel region, a uniform electric field is applied to the electron emission regions to thereby prevent the amount of emitted electrons from being decreased. With the peripheral pixel region, a non-uniform electric field is applied to the electron emission regions such that electrons are emitted only from a specific portion thereof, that is, from the electron emission region surface positioned close to the gate electrode, thereby preventing the electron beams from being spread and striking incorrect color phosphors, and hence the color representation is enhanced.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising:

a plurality of electron emission regions arranged within pixels;

wherein a distance between the electron emission regions and a corresponding gate electrode is differentiated based upon locations of the electron emission regions within the pixels, wherein each of the pixels is divided into a central pixel region and a peripheral pixel region external to the central pixel region, and wherein gate holes are located in the corresponding gate electrode, the gate holes being larger at the peripheral pixel region than the gate holes at the central pixel region.

2. The electron emission device of claim 1, wherein a distance between the electron emission regions located at the central pixel region and the corresponding gate electrode is substantially the same, and the distance between the electron emission regions located at the peripheral pixel region and the corresponding gate electrode is offset toward a center of the central pixel region.

3. The electron emission device of claim 2, wherein the offset of each electron emission region is established such that the distance thereof to the gate electrode directed toward the periphery of the pixel is approximately 1.5 times greater than the distance thereof to the gate electrode directed toward the center of the pixel.

4. An electron emission device comprising:

an anode substrate and a cathode substrate facing each other;

cathode electrodes, an insulating layer, and gate electrodes sequentially deposited on the cathode substrate;

gate holes formed within the gate electrodes at respective pixels, each pixel being divided into a central pixel region and a peripheral pixel region external to the central pixel region;

electron emission regions placed on the cathode electrodes inside the gate holes to emit electrons; and anode electrodes and a phosphor screen formed on the anode substrate, wherein electron emission regions arranged at the central pixel region provide a uniform electric field between electron emission regions in the central pixel region and respective gate electrodes, and electron emission regions arranged at the peripheral pixel region provide a non-uniform electric field between electron emission regions in the peripheral pixel region and respective gate electrodes, wherein the gate holes at the peripheral pixel region are larger than the gate holes at the central pixel region.

5. The electron emission device of claim 4, wherein the respective electron emission regions arranged in the peripheral pixel region are offset toward the center of the pixel.

6. The electron emission device of claim 5, wherein the offset of each electron emission region is established such that the distance from an electron emission region to a respective gate electrode directed toward the periphery of the pixel is approximately 1.5 times greater than the distance from an electron emission region to a respective gate electrode directed toward the center of the pixel.

7. The electron emission device of claim 4, wherein the peripheral pixel region surrounds the central pixel region.

8. The electron emission device of claim 4, wherein the central pixel region and the peripheral pixel region are concentrically symmetrical to each other.

9. The electron emission device of claim 7, wherein the gate holes formed at the central pixel region are formed with the same shape as the plane shape of the electron emission regions.

10. The electron emission device of claim 9, wherein the gate holes formed at the central pixel region are formed with a circular shape.

11. The electron emission device of claim 4, wherein the gate holes formed at a portion of the peripheral pixel region adjacent sides of the central pixel region in the direction of the gate electrodes are formed with a generally rectangular shape longitudinally extended in the direction of the cathode electrodes.

12. The electron emission device of claim 4, wherein the gate holes formed at a portion of the peripheral pixel region adjacent the sides of the central pixel region in the direction of the cathode electrodes are formed with a generally rectangular shape longitudinally extended in the direction of the gate electrodes.

13. The electron emission device of claim 4, wherein gate holes formed at portions of the peripheral pixel region at corners of the central pixel region are formed with a generally square shape.

14. The electron emission device of claim 4, wherein the peripheral pixel region is formed only adjacent to sides of the central pixel region in the cathode electrode direction.

15. The electron emission device of claim 7, wherein the central pixel region and the peripheral pixel region are annularly symmetrical to each other.

16. The electron emission device of claim 4, wherein gate holes formed at the central pixel region are formed with the same shape as the plane shape of the electron emission regions.

17. The electron emission device of claim 16, wherein the gate holes formed at the central pixel region are formed with a circular shape.

18. The electron emission device of claim 14, wherein the gate holes formed at the peripheral pixel region are formed with a generally rectangular shape longitudinally extended in the left and right directions.

19. An electron emission device comprising:

a plurality of electron emission regions arranged within pixels;

wherein a distance between the electron emission regions and a corresponding gate electrode is differentiated based upon locations of the electron emission regions within the pixels, wherein each of the pixels is divided into a central pixel region and a peripheral pixel region external to the central pixel region, and wherein gate holes are located in the corresponding gate electrode a plurality of the gate holes in the central pixel region having a generally circular shape, said distance being a distance between the electron emission regions and an edge of the corresponding gate holes, a plurality of the gate holes in the peripheral pixel region having a generally rectangular shape extending in a direction of the corresponding gate electrode.

* * * * *